United States Patent [19]

Wichmann

[11] 4,169,168

[45] Sep. 25, 1979

[54] PROCESS FOR MANUFACTURING MICROPOROUS CATHODE COATINGS

[75] Inventor: Janice L. Wichmann, Norwood Park TWP; Cook County, Ill.

[73] Assignee: Zenith Radio Corporation, Glenview, Ill.

[21] Appl. No.: 936,411

[22] Filed: Aug. 24, 1978

[51] Int. Cl.[2] ..... B05D 5/12; B05D 3/02; B05D 3/04

[52] U.S. Cl. ..... 427/78; 427/126; 427/314; 427/378; 427/380; 427/419 R; 427/422; 427/427

[58] Field of Search ..... 427/78, 314, 380, 419 R, 427/422, 427, 126, 378

[56] References Cited

U.S. PATENT DOCUMENTS

| | | | |
|---|---|---|---|
| 2,943,957 | 7/1960 | Grattidge | 427/78 |
| 3,722,045 | 3/1973 | Buescher | 427/427 |

*Primary Examiner*—Michael F. Esposito

*Attorney, Agent, or Firm*—Ralph E. Clarke, Jr.

[57] ABSTRACT

A process for depositing a microporous electron-emissive cathode coating material by spray means is depicted. The process comprises preheating the cathode assembly and spray means by enclosing the assembly and spray means in a cathode assembly spray chamber having a laminar flow of gas therein and stabilizing their temperature at a predetermined elevated value. The cathode assembly is sprayed with a first coat of the material to a predetermined initial thickness. The material is fast dried by holding the cathode assembly in an enclosure having a laminar flow of gas at an elevated temperature. A second coat of the material is then sprayed on to a predetermined final overall thickness. Due to the preheating and fast drying according to the invention, the coating material so deposited is uniformly dense and the coating surface is smooth and microporous to provide enhanced emissivity and life and enhanced resistance to poisoning by contaminants.

5 Claims, 7 Drawing Figures

PROCESS FOR MANUFACTURING MICROPOROUS CATHODE COATINGS

BACKGROUND OF THE INVENTION AND PRIOR ART STATEMENT

This invention relates to thermally activated electron-emissive cathodes for electron guns used in television picture tubes, and in particular to an improved process for coating such cathodes with electron-emissive material in manufacture.

Desired characteristics in cathodes include maximum emission with maximum life, resistance to "poisoning" from contaminants, and simplicity of manufacture, with a high yield.

To provide maximum emission and life, a cathode should be microporous; that is, have a relatively smooth surface and be uniformly dense throughout. A uniform density is particularly important with regard to long life; if the cathode coating is microporous, hot spots may develop during cathode emission, and stresses may be induced within the coating which may result in the eventual flaking off of significant portions of the coating, with a consequent reduction in both emission and life of the cathode.

Uniform density and microporosity are also factors in the resistance of the cathode to poisoning by contaminants. Cathode coatings having a rough surface and large expose much larger areas of the cathode coating to the effect of contaminants. The less surface area that is exposed to contaminants, the more resistant the cathodes will be to poisoning. The cathode that is poisoned will have a reduced emission level, or emit for only a short time. Because the cathode often will not fail until after the cathode ray tube has been sealed, or in cases of short life, after it is installed in the product, the effect of a relatively early failure can be troublesome and costly.

Another desired characteristic is that the cathode coating must be easy to apply during manufacture, and the process must provide a high yield. Manufacturing costs can be greatly reduced if the process steps are few, if standard equipment including automated equipment easily adapted to production can be used, and if relatively unskilled personnel can be assigned to the process.

Resistance to poisoning from contaminants is also a factor in reducing costs of manufacture. The manufacturing environment may be high in level of contaminants, particularly with regard to the halogens and the byproducts of such process steps as the cleaning and degreasing of parts. If the cathode coating is resistant to poisoning from such contaminants, precautions required to protect the cathodes from contamination can be made relatively simple, without the need for costly enclosures and elaborately controlled environments.

Prior art methods for coating cathodes comprise, in general, the steps of inserting the cathodes into a suitable holding fixture and causing the cathodes to repetitively pass a spray gun spraying a suspension of electron-emissive compound. More than one such coat may be applied. Such methods, while satisfactory to a certain extent, have proved to be less than adequate in meeting the objectives of uniform density, resistance to contaminants and high yield achieved by the present invention.

OBJECTS OF THE INVENTION

Accordingly, it is a general object of this invention to provide a process of coating of cathodes that provides enhanced emission and enhanced life.

It is another general object to provide a process that will enhance the resistance of cathodes to poisoning from contaminants.

It is a more specific object to provide a cathode coating method that will simplify manufacture while enhancing yields.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

This invention is addressed to a process for depositing an electron-emissive cathode coating material on a cathode assembly by spray means. The process comprises the following steps: Preheating the cathode assembly and the spray means by enclosing the assembly and spray means in a cathode assembly spray chamber having a laminar flow of air therein, and stabilizing the temperature of both the cathode assembly and the spray means at an elevated predetermined value. The cathode assembly is next sprayed with a first coat of the material to a predetermined initial thickness. The material is fast-dried by holding the cathode assembly in an enclosure having a laminar flow of gas at an elevated temperature. The cathode assembly is then sprayed with a second coat of the material to a predetermined final overall thickness. Due to the pre-heating and fast drying according to the invention, the coating material so deposited is uniformly dense and the coating surface is smooth and microporous to provide enhanced emissivity and life and enhanced resistance to poisoning by contaminants.

Figure 1:
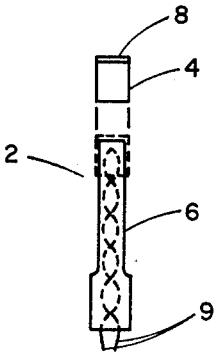
Fig. 1 PRIOR ART
FIG. 1 is an exploded view in elevation of a prior art cathode assembly, greatly enlarged.

The cathode assembly (see FIG. 1) upon which the electron-emissive cathode coating material is deposited by the inventive process is a structure well-known in the art. The cathode assembly 2 comprises a cap 4 fabricated of a nickel-tungsten alloy, and a shank 6 made of an alloy commonly comprising 80% nickel and 20% chromium. A thin, thermally-actuated electron-emissive coating 8 is applied to the top only of cap 4. Thermal activation of the cathode assembly and electron-emissive coating 8 is by means of electrically energized filament wires 9 extending into shank 6; the wires 9 are installed following the coating process. The cap 4 slips over the top of shank 6, as indicated by the dash lines, where it is affixed, usually by resistance welding.

The composition of the electron-emissive material deposited may comprise the following constituents in the percentages specified. The material is compounded in the form of a slurry having a liquidity property suitable for application by spray gun means.

| | |
|---|---|
| (a) Carbonates: | 42 |
| (b) Butyl acetate: | 19.5 |
| (c) Binder solution: | 38.5 |
| TOTAL | 100.0% |

The carbonates (a) may comprise:

| | |
|---|---|
| Barium carbonate | 57 ± 2 |
| Strontium carbonate | 39 ± 2 |
| Calcium carbonate | 4 0 ± 4 |
| TOTAL | 100.0% |

The binder solution (c) may be comprised of a mixture of butyl acetate, butyl cellusolve, and nitrocellulose. A suitable binder solution known to those skilled in the art is supplied by RCA, Trenton, New Jersey.

The median spherical particle size of the coating is 2 to 4 microns. Essentially, the particles have a diameter of 2 microns and a length of from 2 to 18 microns.

It is to be noted that these and other dimensions, measurements, volumes, rates and quantities set forth herein are for example only, and are in no way limiting.

The viscosity and density specifications of the coating material are as follows. The constituents are ball-milled for 24-hours before testing.

Viscosity is measured using a No. 1 Zahn cup. The preferred viscosity is 38 to 40 seconds at 20° to 25° C. The material gets thinner with age so it should be utilized within four months.

Density of the liquified coating material is the weight-to-volume ratio, and is measured using a 2000 milliliter sample. The preferred density is 1.29 to 1.32 grams per cubic centimeter at 22° to 25° C. It is noted again that the limits specified are those shortly following the time of manufacture; the material should be used within four months.

Figure 2:
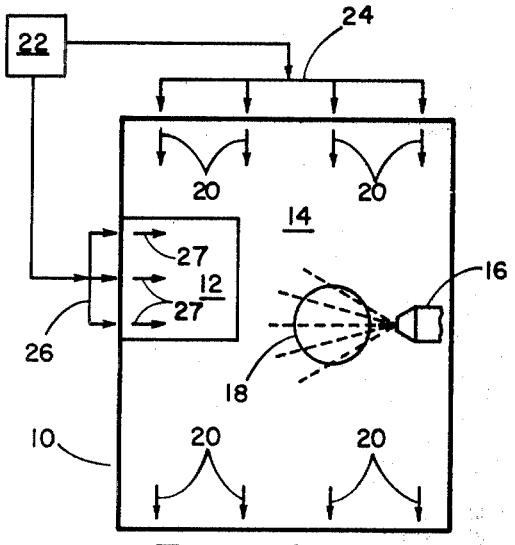
FIG. 2 is a diagram of the interior area of a cathode assembly spray chamber.

The interior of the cathode assembly spray chamber wherein the process according to the invention is accomplished is shown by the schematic diagram, FIG. 2. The interior dimensions of the chamber 10 may be four feet in width by six feet in height, and two feet in depth, for example. An access door (not shown) provides for closing the chamber to maintain a stable environmental temperature therein. The chamber 10 is divided into an inner enclosure which comprises a holding area 12 having dimensions of about one by one-and-one-half feet. A second, larger area comprises spray area 14. Included within spray area 14 are spray means 16 and cathode assembly fixturing means 18, both indicated highly schematically.

Chamber 10 includes means for supplying a laminar flow of gas, preferably air, through spray area 14 from top to bottom, as indicated by descending arrows 20. The source of air is shown as being an external pneumatic pump 22, indicated schematically, which provides clean, filtered, humidity-controlled air to chamber 10 through manifolds 24 and 26, also indicated schematically. It will be noted that the flow of air through holding area 12 is in a crosswise direction, transverse to the laminar flow in spray area 14, as indicated by arrows 26.

The air supply for chamber 10 includes a heating provision for raising air temperature to a predetermined stabilized value, preferably 120° F., but acceptably within a range of 118° to 122° F., according to the invention.

The spray means 16, used for spraying the cathode coating material heretofore described on the cathode assemblies may comprise a standard spray gun such as, for example, Paasche type U-268A cylinder assembly, with a type U-3083 bellows assembly and an A-CU-70 fluid body, supplied by the Paasche Company, Chicago, Ill. The air cap may be a Paasche type SF06-U-5-6, with size 0 tip and needle. Spraying pressure is typically 50 pounds per square inch. The preferred distance from the tip of the gun to the cathode assemblies is 3.8 inches. The gaseous medium for spraying may comprise nitrogen because of its desirable characteristic of inertness and the ready availability of the clean, chemically pure product.

Figure 2A:
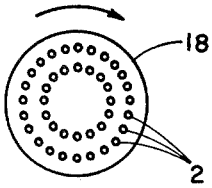
FIG. 2A is a detail view, enlarged, of a cathode assembly fixture means shown by FIG. 2.

The cathode assembly fixturing means 18, shown in greater detail in FIG. 2A, provides for the retention of a quantity of cathode assemblies 2 in two rows, typically in the range of 100–400 assemblies. The fixturing means comprises, essentially, a disc having a plurality of holes for receiving the cathode assemblies. The fixturing means includes masking means to ensure that only the top surface of cap 4 is coated. When loaded, the fixture is attached to a fixture rotating means (not shown) located in the spray area 14 adjacent to spray means 16. The fixture is typically rotated at a speed rate of about 110 revolutions per minute.

The process for depositing a low-porosity electron-emissive cathode coating material on a cathode assembly by spray means according to the invention is now described.

A quantity of cathode assemblies 2 are loaded in fixturing means 18. The fixturing means 18 is attached to the aforedescribed fixture-rotating means located in spray area 14 of chamber 10. The environment within chamber 10 comprises a laminar flow of air indicated by arrows 20 at a temperature of 118° to 122° F., and preferably, 120° F. By the means described, and according to the invention, the temperatures of the cathode assemblies 2 and the spray means 16 are preheated and stabilized at a predetermined elevated value, preferably 120° F. Stabilization may require lodgement in the chamber for a period of, typically, one-half hour.

The cathode assemblies 2 are sprayed with a first coat of coating material to a predetermined thickness. During the spray cycle, the cathode assemblies 2, held in the fixturing means 18, are rotated past the tip of spray means 16 at a rate of 110 revolutions per minute for a period of about 30 seconds. As a result of this first cycle, the initial thickness of the cathode coating 8 is from 1.6 to 1.9 mils.

Following the initial spray cycle, the cathode assemblies 2, retained in the fixturing means 18, are transferred to enclosure 12 of chamber 10 for a period sufficient to acceleratively dry the material. Drying is accomplished by acceleratively evaporating the spray vehicle and drying the coating material and its binder. The drying and evaporation is aided by the laminar flow of air indicated by arrows 26. The cathode assemblies are lodged in the enclosure for a period of five to ten minutes.

While in the holding area, samples may be selected for testing of thickness of the coating. The thickness is relative to the spray gun set-up and its rate of spray for a reflectivity range of 65–68% as measured on a two by three-inch glass slide in an appropriate fixture. The reflectivity measurement is set up with reference to magnesium sulphate standard at 98% reflectivity, and may be measured with a standard reflectometer such as the Gardner Model No. UXHS1D.

The cathode assemblies 2 and fixturing means 18 are then removed from holding area 12 and returned to spray area 14. Fixturing means 18 is attached to the fixture-rotating means and the fixturing means is again rotated past the tip of spray means 16 at a rate of 110 revolutions per minute. The cathode assemblies 2 are sprayed with a second coat of material to a predetermined final overall thickness. The spray period may range from 20 to 30 seconds, or whatever time is necessary to achieve a final overall coating thickness of 3 to 4 mils.

When applied by the process according to the invention, the coating material deposited will have a uniform density of 0.8 to 1.2 grams per cubic centimeter for each layer and the total coating. The density of the applied coating is calculated by determining the weight-to-volume ratio. Weight of the coating is determined by weighing a cathode assembly when coated, and weighing the assembly again with the coating removed. Volume is determined by measuring the thickness of the coating at the center of cap 4, for example. Density is calculated based upon a number of samples, as is well-known in the art.

Figure 3A:
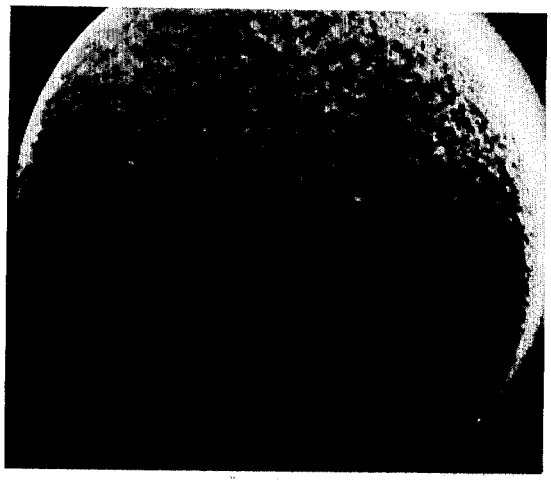
Fig. 3A PRIOR ART
FIGS. 3A and 3B are scanning electron photomicrographs of cathode assembly surface coated according to the prior art; and, FIGS. 4A and 4B are scanning electron photomicrographs of cathode assembly surface coated by the process according to the invention.
Figure 4A:
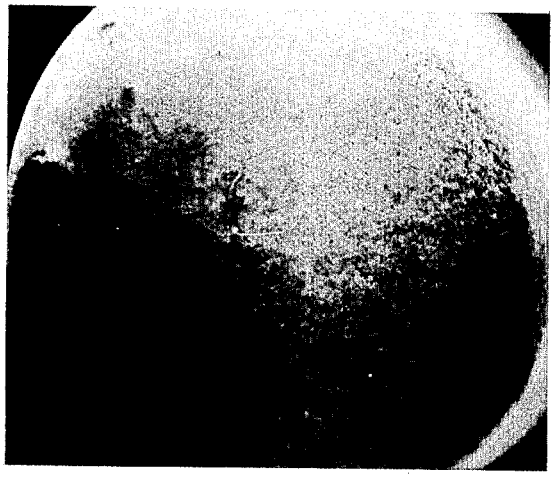
Figure 3B:
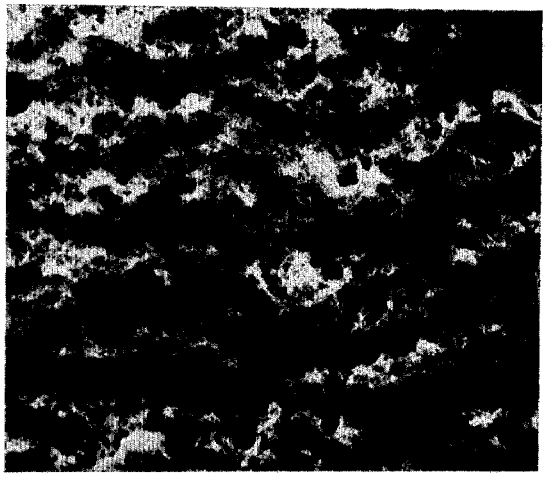
Fig. 3B PRIOR ART
Figure 4B:
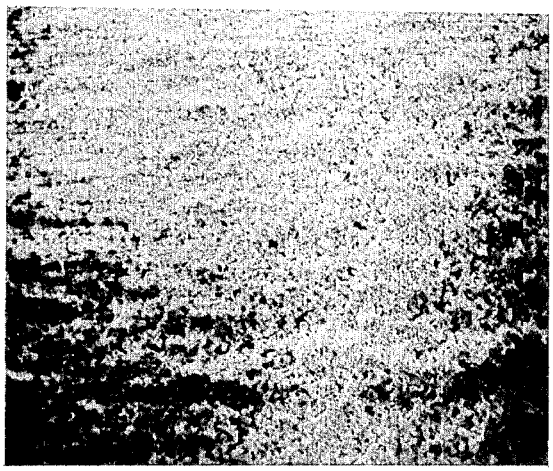

The benefits of the process according to the invention are shown by a comparison of FIGS. 3A and 3B with FIGS. 4A and 4B, all of which are scanning electron microphotographs of the surfaces of coated cathodes after activation. FIG. 3A is a 50× enlargement of the surface of a prior art cathode, and FIG. 3B is an 180× enlargement of the surface of the same cathode. The microporosity and roughness of the surface of the cathode are clearly apparent, especially by comparison with the cathode surfaces shown by FIGS. 4A and 4B.

FIG. 4A is a 50× enlargement of the surface of a cathode coated by the process according to the invention, while FIG. 4B is an 180× enlargement of the surface of the same cathode. The microporosity of the coating will be noted, a condition ensuring that "hot spots" will not develop. Also, the marked smoothness of the surface along with the microporosity provides enhanced resistance to poisoning by contaminants. As a result, a cathode coated by the process according to the invention will provide enhanced emissivity throughout its operating life.

The value of the inventive process is shown by the fact that the process has been used in the manufacture of approximately four million cathodes to date, supplying well over one million cathode ray picture tubes.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A process for depositing a microporous electron-emissive cathode coating material on a cathode assembly by spray means, the process comprising:

preheating said cathode assembly and said spray means by enclosing said assembly and said spray means in a cathode assembly spray chamber having a laminar flow of gas therein, and stabilizing the temperature of said assembly and said spray means at a predetermined elevated value;

spraying said cathode assembly with a first coat of said material to a predetermined initial thickness;

fast drying said material by holding said cathode assembly in an enclosure having a laminar flow of gas at an elevated temperature;

spraying said cathode assembly with a second coat of material to a predetermined final overall thickness;

whereby due to said preheating and said fast drying, said coating material so deposited is uniformly dense and the coating surface is smooth and microporous to provide enhanced emissivity and life and enhanced resistance to poisoning by contaminants.

2. The process according to claim 1 wherein said temperature of said cathode assembly and spray means is stabilized at 118° to 122° F.

3. The process according to claim 1 wherein said cathode assembly is held and fast dried for a period of 5 to 10 minutes.

4. The process according to claim 1 wherein said gas comprises air.

5. A process for depositing a microporous electron-emissive cathode coating material on cathode assemblies by spray means, the process comprising:

means by preheating said cathode assembly and said spray means by enclosing said assemblies and spray means in a cathode assembly spray chamber having a laminar flow of air therein; and stabilizing the temperature of said assembly and spray means at a predetermined elevated temperature of 118° to 122° F.;

spraying said cathode assemblies with a first coat of said material to a predetermined initial thickness;

fast drying said material by holding said cathode assemblies in said chamber for a period of 5 to 10 minutes to acceleratively dry said material;

spraying said cathode assemblies with a second coat of said material to a predetermined final overall thickness;

whereby due to said preheating and said fast drying, said coating material so deposited is uniformly dense and the coating surface is smooth and microporous to provide enhanced emissivity and life and enhanced resistance to poisoning by contaminants.

* * * * *